US006889777B2

(12) United States Patent
Boley et al.

(10) Patent No.: US 6,889,777 B2
(45) Date of Patent: May 10, 2005

(54) IMPLEMENT FOR DRIVING POSTS

(75) Inventors: Neil Boley, Sheridan, WY (US); Archie Carrico, Parkman, WY (US)

(73) Assignee: Thumpers, Inc., Sheridan, WY (US)

( * ) Notice: Subject to any disclaimer, the term of this patent is extended or adjusted under 35 U.S.C. 154(b) by 0 days.

(21) Appl. No.: 10/103,198

(22) Filed: Mar. 15, 2002

(65) Prior Publication Data

US 2003/0173095 A1 Sep. 18, 2003

Related U.S. Application Data

(60) Provisional application No. 60/276,821, filed on Mar. 16, 2001.

(51) Int. Cl.[7] ..... B25D 9/06; E21B 1/02

(52) U.S. Cl. ..... 173/90; 173/25; 173/42; 173/112; 173/135; 173/190; 173/194; 173/200; 175/202; 175/296

(58) Field of Search ..... 173/90, 84, 128, 173/206, 200, 152, 112, 89, 27, 25, 207, 135, 11, 19, 193, 194, 40, 190, 42, 39; 175/296, 202

(56) References Cited

U.S. PATENT DOCUMENTS 3,442,338 A * 5/1969 Broderson ..... 173/86
3,700,047 A * 10/1972 Gartner ..... 173/28
3,712,389 A * 1/1973 Smoak ..... 173/126

(Continued)

OTHER PUBLICATIONS

Kiwi Post Driver sales brochure, Kiwi Fence Systems, Inc., Waynesburg, PA.
Fairbrother King Hitter sales brochure, Fairbrother Ind. USA Inc., Fort Worth, TX.
Fairbrother Products product specifications, found on the World Wide Web at http://www.fairbrotherind.com/products/specs.htm, Nov. 10, 2000.
Fairbrother Products product specifications, found on the World Wide Web at http://www.fairbrotherind.com/products/series12.htm, Nov. 10, 2000.
Fairbrother Products product specifications, found on the World Wide Web at http://www.fairbrotherind.com/products/accessories.htm, Nov. 10, 2000.
Shaver Post Drivers sales brochure, Shaver Manufacturing Company, Graettinger, IA.
Worksaver Post Drivers and Post Hole Diggers sales brochure, Worksaver, Inc., Litchfield, IL, 1999.
Munro Tele–Sett/Multi–Sett sales brochure, Munro Engineers Pty Ltd., Ballart, Victoria, Australia.
Munro Tele–Sett/Multi–Sett Specifications, Options, Safety, web pages on the World Wide Web at http://www.munroeng.com, Nov. 10, 2000.
Bradco Postmaster, Slabmaster & Combo sales brochure, Bradco, a division of Attachment Technologies, Delhi, IA, 12/99.

*Primary Examiner*—Stephen F. Gerrity
*Assistant Examiner*—Gloria R. Weeks
(74) *Attorney, Agent, or Firm*—Sheridan Ross P.C.

(57) ABSTRACT

A post driving implement for use with a vehicle, such as a tractor or a skid loader, is disclosed. The post driving implement is comprised of a hammer, a hammer channel, and a hammer cylinder. The hammer travels longitudinally within the hammer channel and is lifted by the hammer cylinder mounted to a closed end of the hammer channel. The hammer cylinder and its associated plumbing is of sufficient size to function as a hydraulic reservoir for the post driving implement, thus eliminating the need for a third hydraulic line to the reservoir on the vehicle and to avoiding need for alteration of the vehicle's reservoir. The post driving implement of the present invention may also include a back plate for mounting the implement to a vehicle. Additionally, the post driving implement may include adjustment mechanisms to vary the positional and angular relationship between the vehicle and the implement.

13 Claims, 3 Drawing Sheets

U.S. PATENT DOCUMENTS 3,961,672 A 6/1976 Welsch et al. ..... 173/43
4,410,049 A * 10/1983 Molin ..... 173/2
4,570,723 A * 2/1986 Kostylev et al. ..... 173/90
4,665,994 A 5/1987 Snider ..... 173/90
4,720,904 A 1/1988 Palla, Jr. ..... 29/275
4,799,556 A * 1/1989 Foster et al. ..... 173/193
4,971,479 A 11/1990 Byers, Sr. et al. ..... 405/232
5,029,651 A 7/1991 Ubbink ..... 175/19
5,042,591 A 8/1991 Hull ..... 173/91
5,282,511 A 2/1994 Burenga et al. ..... 173/184
5,291,953 A 3/1994 Mitchhart ..... 173/90
5,332,047 A * 7/1994 Hignite ..... 173/1
5,392,866 A 2/1995 White ..... 173/90
5,494,117 A 2/1996 Aldridge ..... 173/28
5,551,519 A * 9/1996 Pach ..... 173/184
5,806,608 A 9/1998 DuBois ..... 173/90
5,819,857 A 10/1998 Rohrer ..... 173/90
5,853,052 A * 12/1998 Baiden et al. ..... 173/15
5,984,021 A * 11/1999 Pascale ..... 173/90
6,305,480 B1 * 10/2001 Franklin ..... 173/27
6,349,777 B1 * 2/2002 Burenga et al. ..... 173/187
6,439,317 B1 * 8/2002 Minotti et al. ..... 173/89
6,517,294 B2 * 2/2003 Vreeland ..... 405/302.7

* cited by examiner

IMPLEMENT FOR DRIVING POSTS

CROSS-REFERENCE TO RELATED APPLICATIONS.

Priority is claimed from U.S. Provisional Patent Application No. 60/276,821 filed Mar. 16, 2001 entitled "Implement for Driving Posts," which is incorporated by reference in its entirety.

FIELD OF THE INVENTION

The present invention relates generally to the driving of posts and more particularly to a fluid actuated power post driving device which may be mounted on a tractor, skid loader or other machinery.

BACKGROUND OF THE INVENTION

Driving fence posts and other posts requires considerable manual effort. Manual post drivers typically include a heavy sleeve with a closed end with appropriate handles such that an operator may slide the sleeve up and down on the post to drive it into the ground. The manual effort required to drive posts, in this or other manners, increases significantly with a large number of posts to be driven. Further, ground conditions such as rocky, dry or frozen soil can significantly increase the effort required in the labor intensive task.

To this end, implements have been developed to automate the placement of posts into the ground. Many of these implements include a mounting bracket so that the implement may be connected to a vehicle such as a tractor, a pickup truck or a skid loader. Generally, the implement draws power from the vehicle. This implement may be powered by hydraulic, electrical, or mechanical energy. For hydraulic powered post driving implements, the hydraulic energy is provided by a hydraulic pump on the vehicle. The associated hydraulic fluid reservoir on the vehicle may require adaptation to accommodate the additional hydraulic fluid required to operate the hydraulic implement or a smaller hydraulic cylinder must be used on the post driving implement. The use of a smaller implement may increase the time required to drive posts. Typically, a weight is lifted by a hydraulic cylinder and released. The weight drops under the natural force of gravity, or may be assisted in the downward direction by spring force, to strike the post and thus, drive it into the ground. The larger the cylinder employed in the implement, the larger the weight may be that is raised and dropped. Additionally, these prior art post drivers require additional time to lift the weight and thus are inefficient in driving posts.

Prior art post drivers often require external support such as outriggers. The external support limits the size of a post to be driven. Since the external supports must interface with the ground, the length of a post to be driven is limited to sizes which can fit into a post driver mounted, at least in part, on the ground.

SUMMARY OF THE INVENTION

The present invention is drawn to a hydraulic implement for driving posts. The implement for driving posts of the present invention includes a weight (or hammer), a channel for constraining the hammer, and a hydraulic cylinder for raising and lowering the hammer. The implement for driving posts of the present invention may also include a bracket for facilitating connection of the implement to a vehicle.

The present invention seeks to overcome the perceived deficiencies of previously existing hydraulic post driving implements by first providing a larger hammer cylinder. By utilizing a larger cylinder, the implement may incorporate a heavier weight and, thus, decrease the time required to drive a post into the ground. The use of a larger cylinder also allows a longer cylinder stroke, such that the hammer may be lifted a greater distance above the post to be driven, thus providing greater striking force which also reduces the time required to drive a post. Additionally, a larger cylinder can reduce the time required to lift the hammer, thereby further increasing efficiency of the post driving operation.

The present invention seeks to overcome other perceived deficiencies of previously existing hydraulic post driving implements by providing a hammer cylinder and a plumbing assembly (including tubing, piping and/or fittings) of appropriate volumetric size such that the hammer cylinder's plumbing may act as a reservoir for the hydraulic fluid required to operate it. This aspect of the invention makes a return line to the hydraulic reservoir of the vehicle unnecessary, and thus reduces the time required to connect the implement to the vehicle. More particularly, post driving implements disclosed in the prior art include three hydraulic lines connected to the cylinder of the post driving implements. The first line is an "in" line that provides hydraulic fluid from the vehicle into the cylinder. The second line is an "out" line that sends excess hydraulic fluid back to the vehicle from the cylinder. The third line acts as a flow release reservoir for the hydraulic fluid displaced as a result of the implement's cylinder stroke. The third line is typically a larger independent line that is positioned along the vehicle somewhere, and is tapped into the vehicle's hydraulic fluid reservoir. The present invention eliminates the need of the third line. More particularly, upon activation of the hammer cylinder, the implement's plumbing assembly (including tubing, piping and/or fittings) serves to accommodate the displaced hydraulic fluid. Although some minor amount of fluid may also move from the implement plumbing to the vehicle's plumbing (including tubing, piping and/or fittings), the combination of the implement plumbing and the vehicle plumbing is sufficient to accommodate the displaced hydraulic fluid without the need for the addition of a separate third line to the vehicle that is tapped into the vehicle's hydraulic fluid reservoir. Therefore, the post driving implement of the present invention may be quickly connected to the vehicle using the two available "in" and "out" quick-connect couplings typically available on the vehicle.

The present invention may also include a plurality of adjustment cylinders mounted transverse to the channel for constraining the hammer to allow for angular adjustment of the implement. The mounting bracket connected to the vehicle may provide an additional direction of angular adjustment by tilting of the portion of the vehicle to which it is attached. For example, if the implement is attached to a skid loader, the hydraulicly powered arms of the skid loader may be actuated to move one end of the channel toward or away from the skid loader. The present invention may thus be provided with multiple degrees of freedom. The ability to adjust the angular relationship of the post driving implement may allow a post to be driven vertically although the vehicle is on uneven or slanted ground.

DETAILED DESCRIPTION

Figure 1:
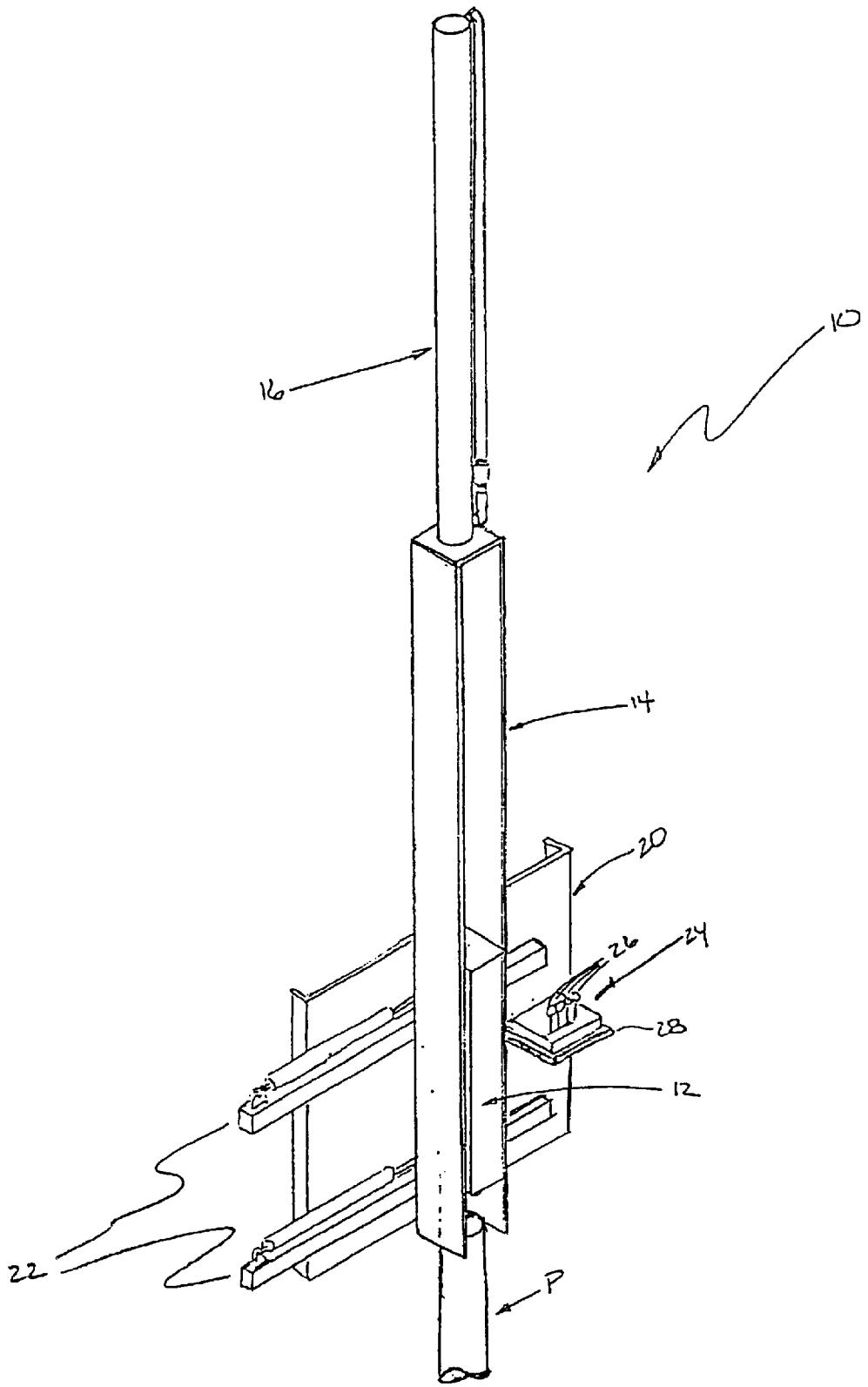
FIG. 1 is a front perspective view of one embodiment of the implement for driving posts of the present invention.

With reference to FIG. 1, one embodiment of the implement for driving posts of the present invention is shown. The post driving implement 10 includes a hammer 12, a hammer channel 14 and a hydraulic cylinder, hereinafter referred to as hammer cylinder 16. The hammer 12 is a large weight which is lifted by the hammer cylinder 16 some distance above the post P to be driven and released to fall under the natural forces of gravity. As the hammer 12 strikes the post, the post is forced into the ground. The hammer 12 travels longitudinally within the hammer channel 14 to help constrain and control the motion of the hammer 12. The hammer channel 14 has an open longitudinal side such that the post P may be inserted into the hammer channel 14 or the vehicle may maneuver the post driving implement 10 into position around a post P that has been placed into a starter hole in the earth. The hammer cylinder 16 is mounted on one end of the hammer channel 14 and arranged such that the reciprocal motion of the hammer cylinder rod 18 travels in a longitudinal direction parallel to the travel of the hammer 12 within the hammer channel 14.

In a separate aspect of the present invention, a large hammer cylinder 16 is used. The additional size of the hammer cylinder 16 also provides for the use of a heavier hammer 12 with the implement 10. The additional hydraulic capacity and the larger size of the hammer cylinder 16 also increases the length of travel of the hammer cylinder rod 18, and allows for the lifting and dropping of the hammer 12 in less time, thereby increasing the efficiency of driving posts.

With further reference to FIG. 1, the post driving implement 10 is connected to a back plate 20. The back plate 20 is connected to the hammer channel 14, preferably along the longitudinal side of the hammer channel 14 opposite the open portion of the channel 14. The back plate 20 is used to connect the post driving implement 10 to a vehicle. The construction of the back plate 20 is discussed in greater detail below.

The post driving implement 10 may also include means for adjustably positioning implement 10. The adjustable positioning means may include a plurality of adjustment mechanisms 22. The adjustment mechanisms 22, if included in the implement 10, are mounted between the back plate 20 and the hammer channel 14. The adjustment mechanisms 22 provide movement of the hammer channel 14 relative to the back plate 20. If a first adjustment mechanism is moved a distance different than a second adjustment mechanism, the hammer channel 14 may be adjusted to a different angular relationship relative to the back plate 20. If all adjustment mechanisms 22 are moved an equivalent distance, the position of the hammer channel 14 may be moved relative to the back plate 20 without altering the angular relationship thereto. If a skid loader is the vehicle used in conjunction with the post driving implement 10, a single adjustment mechanism 22 may be used. Often, skid loaders have the ability to adjust its arms from side to side, thus obviating the need for the adjustment provided by moving multiple adjustment mechanism 22 an equivalent distance. Moreover, skid loaders are more maneuverable than tractors. A single adjustment mechanism 22 may provide the desired angular adjustment of the hammer channel 14 relative to the back plate 20. The construction of the adjustment mechanism 22 is described in greater detail below.

A control panel 24 may also be attached to the back plate 20. The control panel 24 includes hydraulic control devices 26 to manipulate or actuate various valves in the system. For example, a hydraulic control device 26 may be used to operate a valve to the adjustment mechanism 22 so an operator may stand at the back plate 20 and adjust the angular position of the post driving implement 10 as desired. As shown in FIG. 1, the control panel 24 is mounted to a control plate 28 which is attached to the back plate 20. The hydraulic control devices 26 of FIG. 1 are shown as levers, however, it is understood that any known mechanism for actuating a valve may be used.

Figure 2:
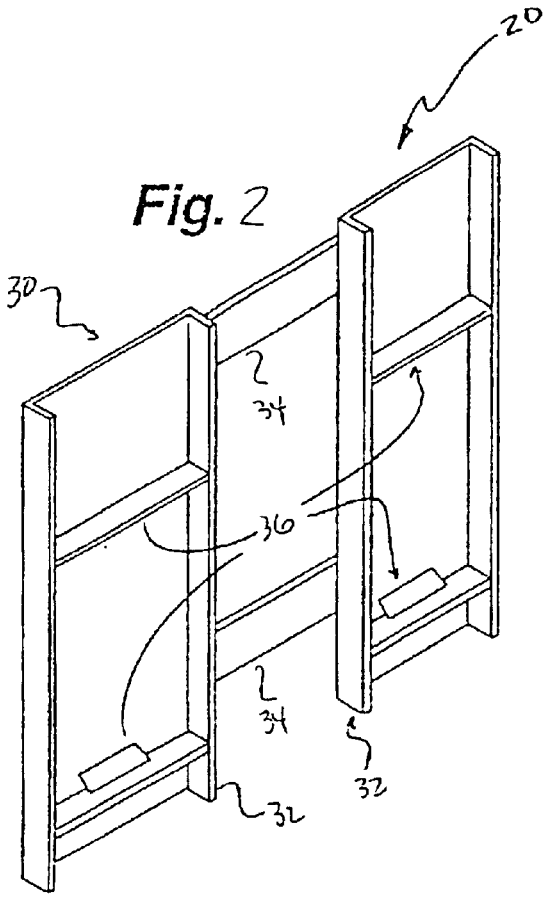
FIG. 2 is a rear perspective view of one embodiment of the mounting bracket of the present invention.

With reference to FIG. 2, one embodiment of the back plate 20 is shown. The back plate 20 has a mounting surface 30 for attachment to the post driving implement 10. In the embodiment shown in FIG. 2, the mounting surface 30 is formed by a pair of bracket channels 32 and a plurality of cross plates 34. The cross plates provide a mounting surface for the hammer channel 14 of the implement 10. The hammer channel 14 may be attached to the back plate 20 by welding, bolts, pins, or any other known method of attachment. The interior area of the bracket channels 32 includes cross braces 36 to provide the appropriate surface arrangement for connection with the vehicle. Although myriad structural arrangements are possible, preferably the structural arrangement is chosen to accommodate connection to several types of vehicles, e.g., a skid loader and a tractor. The connection of the back plate 20 to the vehicle is preferably achieved in a non-permanent manner by bolts, pins, and the like so that the post driving implement 10 may be removed when not in use.

Figure 3:
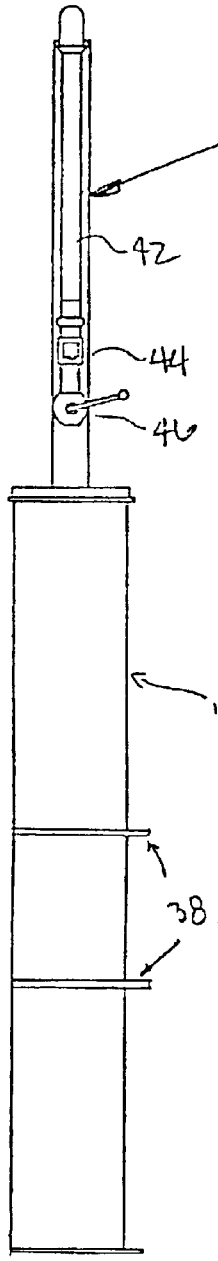
FIG. 3 is a side elevation view of one embodiment of the hammer cylinder and channel of the present invention.

With reference to FIG. 3, one embodiment of the post driving implement 10 is shown in side elevation view. The hammer channel 14 may include support brackets 38 which increase the structural integrity of the hammer channel 14 for constraining the hammer 12. The support brackets 38 may also be used to attach the hammer channel 14 to the back plate 20.

FIG. 3 also shows the hammer cylinder 16 attached to the hammer channel 14 at its closed end. The hammer cylinder 16 is connected to a plumbing assembly 40. The plumbing assembly 40 comprises tubing 42, a tee fitting 44, and valve 46. The tee fitting 44 is connected to the tubing 42 at two branches. The third branch of the tee fitting 44 is connected to a supply line (not shown). The supply line is connected, either directly or indirectly, to the discharge of a hydraulic pump of the vehicle. The plumbing assembly 40 is of sufficient size to function as a hydraulic reservoir for the fluid required by the post driving implement 10. As a result, a third hydraulic line (a return line to the vehicle's hydraulic fluid reservoir) is unnecessary. Without the need to connect an additional hydraulic line, the time required to attach the post driving implement 10 to a vehicle is reduced.

Valve 46 is located in the tubing 42 between the tee fitting 44 and the end of the hammer cylinder 16 attached to the hammer channel 14. The valve 46 is used to control hydraulic fluid to lift the hammer 12. When the valve 46 is in one position, hydraulic fluid pressurized by the vehicle's hydraulic pump enters the hammer cylinder 16 to raise the hammer 12. When the valve 46 is in a second position, the pressure acting to raise the hammer 12 is removed and the hammer 12 is allowed to fall under the force of gravity. While any valve may be used, valve 46 is preferably a ball valve or other valve type which may be rapidly shifted from one position to another such that the time to raise the hammer 12 is minimized and the hammer 12 drops quickly from the desired position without incurring a resistive force.

In a separate aspect of the invention, means for controlling the flow of hydraulic fluid to the hammer cylinder 16 are also provided. More particularly, the present invention also encompasses various means for controlling valve 46. The valve 46 may be operated manually by direct manipulation of the valve 46, or by providing a linkage to a control device 26 on the control panel 24. The valve 46 may also be attached to a trip rod or rope (not shown) which may be controlled by the operator of the vehicle. In this way, once the post driving implement 10 is properly positioned, the operator may raise and drop the hammer 12 from the cab of the vehicle. The valve 46 may also be controlled by a connected actuator (not shown). The connected actuator may use an electric signal to shift position of the valve 46. An electric actuator may be used to index the valve 46 to a desired position from virtually any position where the control wires have been routed to a control switch. For example, the valve 46 may be indexed, and thus the post driving implement 10 operated, at an elevated position by routing an electrical cord from the actuator to a control box for use by an operator standing on the ground to operate the implement 10 at the elevated position.

Figure 4:
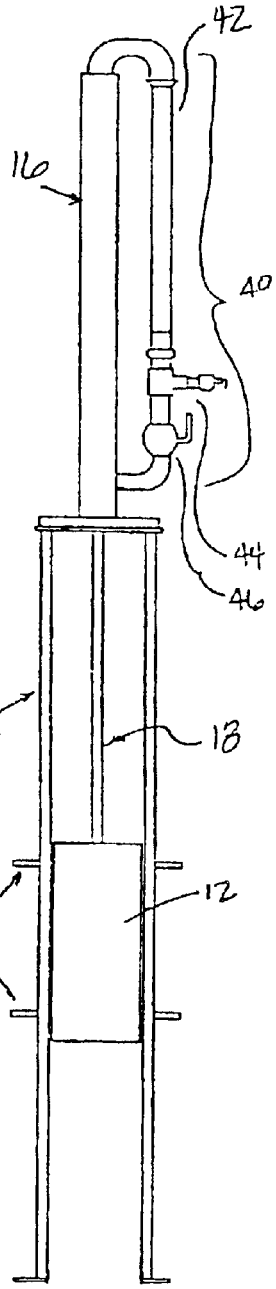
FIG. 4 is a front elevation view of the embodiment of FIG. 3.

With reference to FIG. 4, the post driving implement 10 of FIG. 3 is shown in a front elevation view. FIG. 4 again shows the plumbing assembly 40 and the hammer cylinder 16 connected at one end to the closed end of the hammer channel 14. FIG. 4 also shows the hammer 12 within the hammer channel 14 and connected the hammer cylinder rod 18. As described above, flow of hydraulic fluid into the hammer cylinder 16 may be controlled to retract and release the hammer cylinder rod 18 which, when connected to the hammer 12, raises and releases the hammer 12. Although not shown, the hammer channel 14 may include additional components to assist in driving a post. For example, levels or plumb bobs may be attached to the hammer channel 14 to ensure that the post is driven in the vertical direction. A chain or strap may also be provided along the hammer channel 14 to secure a post P within the channel 14. The chain or strap may be selectively removed as desired to allow placement of the post P within hammer channel 14 while maneuvering the vehicle into position and replaced to contain the post P once the operator is prepared to drive the post.

Figure 5:
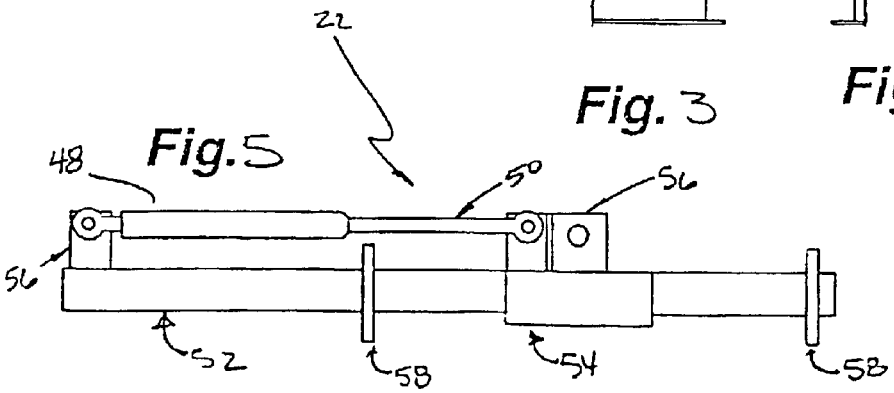
FIG. 5 is a front elevation view of one embodiment of the transverse angular adjustment mechanism of the present invention.

With reference to FIG. 5, one embodiment of an adjustment mechanism 22 is shown in front elevation view. The adjustment mechanism 22 includes an adjustment cylinder 48 with an adjustment cylinder rod 50, an adjustment bar 52, and an adjustment slide 54. The adjustment slide 54 is slidably connected to the adjustment bar 52. The adjustment bar 52 may be fabricated from metallic tubing. Similarly, the adjustment slide 54 may also be fabricated from metallic tubing, but with an interior geometry large enough to fit over the exterior surfaces of the adjustment bar 52, and thus travel longitudinally along the adjustment bar 52. The adjustment cylinder 48 may be connected at one end to a mounting bracket 56 attached to the adjustment bar 52. At the opposite end of the adjustment cylinder 48, the adjustment cylinder rod 50 may be attached to the adjustment slide 54 or a mounting bracket 56 attached to the slide 54. Thus, by controlling the flow of hydraulic fluid to the adjustment cylinder 48 and therefore extending or retracting the adjustment cylinder rod 50, the adjustment slide 54 may be moved longitudinally along the adjustment bar 52. In operation, the adjustment bar 52 is connected to the back plate 20 and the adjustment slide 54 is connected to the hammer channel 14. Therefore, the movement of the adjustment slide 54 relative to the adjustment bar 52 changes the positional relationship between the back plate 20 and the hammer channel 14. The adjustment bar 52 may also include end stops 58 to constrain the travel of the adjustment slide 54 along the adjustment bar 52. The position of the end stops 58 may thus provide a limited maximum angular relationship between the hammer channel 14 and the vehicle of choice to prevent tipping of the vehicle, for example.

Figure 6:
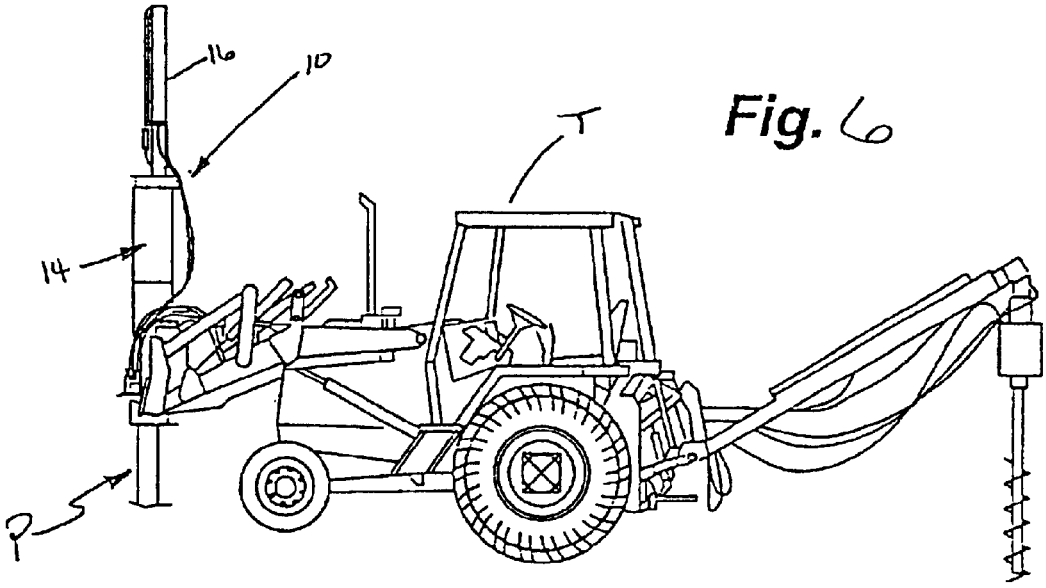
FIG. 6 is a side perspective view one embodiment of the implement for driving posts shown connected to a tractor.
Figure 7:
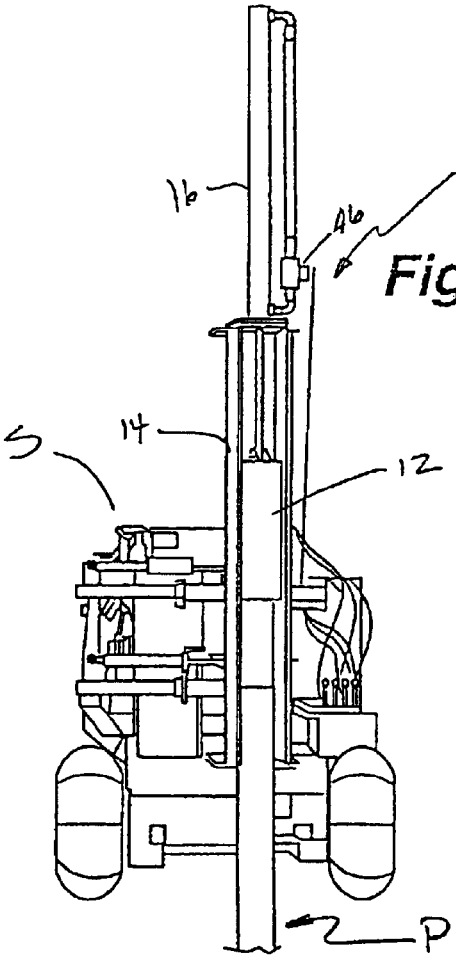
FIG. 7 is a front perspective view of one embodiment of the implement for driving posts of the present invention shown attached to a skid loader.

As shown in FIGS. 6 and 7, the post driving implement 10 of the present invention is intended to be used with a vehicle. In FIG. 6, the implement 10 is used with a tractor T. The present invention is mounted to the load arms of the tractor. Hydraulic hoses necessary to operate the implement 10 of the present invention are connected to hydraulic hoses on the load arms which, in turn, are connected to the hydraulic system (including a hydraulic pump) of the tractor T. Similarly, in FIG. 7, the implement 10 used with a skid loader S. The hydraulic hoses are similarly connected to the hydraulic hoses provided on the skid loader S to provide the hydraulic power to the post driving implement 10. Also shown in FIG. 7, the post driving implement 10 may be lifted to an elevation above the ground surface by the load arms on the skid loader S (or tractor T). Since no external support, such as outriggers, is required, the post driving implement 10 of the present invention may be used to drive posts of uncommon length. For example, the post driving implement of the present invention may be used to install well casing or to drive a post which may be used to support a regulation height basketball hoop.

While various embodiments of the present invention have been described in detail, it is apparent that modifications and adaptations of those embodiments will occur to those skilled in the art. However, it is to be expressly understood that such modifications and adaptations are within the spirit and scope of the present invention.

What is claimed is:

1. A post driving implement adapted for use with a vehicle, the vehicle having a hydraulic fluid reservoir, said post driving implement comprising:

a weight slidably contained within a channel, said channel including an open end, a closed end, and a longitudinal axis;

a hydraulically powered cylinder positioned at said closed end and above said channel, said cylinder having a cylinder rod, said cylinder oriented parallel to said longitudinal axis of said channel, said cylinder rod extending into said channel and interconnected to said weight, wherein said cylinder rod is reciprocated in and out of said cylinder to raise and release the weight onto an object;

a plumbing assembly connected to said cylinder and in operable communication with the cylinder and the vehicle;

a back plate having a back surface interconnected to the vehicle; and an adjustment mechanism adapted for orienting said longitudinal axis of said channel in a plurality of distinct positions, said adjustment mechanism comprising an adjustment cylinder interconnected on a first end to an adjustment bar and said back plate, said adjustment cylinder interconnected on a second end to an adjustment cylinder rod, said adjustment cylinder rod interconnected to an adjustment slide, said adjustment slide interconnected to said channel, wherein said adjustment bar is selectively slideable within said adjustment slide upon controlling a hydraulic fluid to said adjustment cylinder, and wherein said adjustment mechanism is positioned between said back plate and said channel.

2. The post driving implement as claimed in claim 1, wherein said adjustment mechanism can tilt and move said channel in a plane that is substantially parallel to said back surface of said back plate.

3. The post driving implement as claimed in claim 2, wherein said adjustment cylinder is substantially horizontally oriented, including during tilting or moving said channel.

4. The post driving implement as claimed in claim 1, further comprising a plurality of end stops positioned along said adjustment bar, a first of said plurality of end stops located on a first side of said adjustment slide and a second of said plurality of end stops located on an opposite side of said adjustment slide, wherein said end stops limit the distance that said adjustment bar can laterally slide within said adjustment slide.

5. The post driving implement as claimed in claim 1, wherein said implement is mounted to either a skid loader or a tractor.

6. The post driving implement as claimed in claim 1, wherein said open end is sized to receive a post.

7. A post driving implement removably attachable to a vehicle, the vehicle having a hydraulic system including a pump and a hydraulic fluid reservoir, said post driving implement comprising:

a channel including a weight slidable therein;

a hammer cylinder located above said channel and interconnected to said channel, said hammer cylinder including a cylinder rod slidably movable within said hammer cylinder, said cylinder rod interconnected to said weight;

a plumbing assembly between said hammer cylinder and the hydraulic system of the vehicle;

means for controlling hydraulic fluid flow from the vehicle's hydraulic pump to said hammer cylinder, wherein said means for controlling permits said cylinder rod to be retracted into said cylinder to raise said weight, and permits said cylinder rod to be released to drop said weight onto a post; and an adjustment mechanism interconnected to said channel, said adjustment mechanism comprising an adjustment cylinder interconnected on a first end to an adjustment bar said adjustment cylinder interconnected on a second end to an adjustment cylinder rod, said adjustment cylinder rod interconnected to an adjustment slide wherein said adjustment bar is selectively slideable within said adjustment slide upon controlling a hydraulic fluid to said adjustment cylinder, wherein said adjustment mechanism can tilt and move said channel in a plane that is substantially parallel to a back surface of said channel.

8. The post driving implement as claimed in claim 7, further comprising a plurality of end stops positioned along said adjustment bar, a first of said plurality of end stops located on a first side of said adjustment slide and a second of said plurality of end stops located on an opposite side of said adjustment slide, wherein said end stops limit the distance that said adjustment bar can laterally slide within said adjustment slide.

9. The post driving implement as claimed in 7, further comprising a back plate interconnected to said channel, said adjustment mechanism located between said channel and said back plate.

10. The post driving implement as claimed in claim 7, wherein said controlling means comprises a lever-actuated ball valve, said ball valve located above said channel.

11. The post driving implement as claimed in claim 7, wherein said implement is mounted to either a skid loader or a tractor.

12. A method of driving a post using a post driving implement attached to a vehicle, the vehicle having a hydraulic pump and a hydraulic fluid reservoir, said method comprising the steps of:

connecting the post driving implement to the vehicle, the post driving implement including a channel and a hammer cylinder interconnected to the channel and located above the channel, wherein the hammer cylinder includes a cylinder rod slidably movable within the hammer cylinder, the cylinder rod being interconnected to a weight disposed within the channel, the implement further having a plumbing assembly;

placing the post driving implement in operative association with a post to be driven in the ground, said placing step including adjusting a plurality of adjustment mechanisms, at least one of said plurality of adjustment mechanisms comprising an adjustment cylinder interconnected on a first end to an adjustment bar, the adjustment cylinder having an adjustment cylinder rod on a second end, the adjustment cylinder rod interconnected to an adjustment slide, wherein the adjustment bar is selectively slideable within the adjustment slide upon controlling a hydraulic fluid to the adjustment cylinder, engaging the vehicle's hydraulic pump to provide pressurized hydraulic fluid to the implement;

actuating the post driving implement to lift the weight within the channel; and actuating the post driving implement to release the weight within the channel by closing a ball valve located above the channel using a linkage rod, thereby causing the weight to fall and strike the post.

13. The method as claimed in claim 12, wherein said connecting step further includes the step of completing hydraulic connection to the vehicle by:

(a) attaching a hydraulic fluid "in" line from the vehicle to the implement; and (b) hydraulic fluid "out" line from the implement to the vehicle.

* * * * *